United States Patent [19]

Umezawa

[11] 4,378,821

[45] Apr. 5, 1983

[54] WEFT DETAINING DEVICE OF SHUTTLELESS LOOM

[75] Inventor: Hidetsugo Umezawa, Narahashi, Japan

[73] Assignee: Nissan Motor Co., Ltd., Yokohama, Japan

[21] Appl. No.: 275,714

[22] Filed: Jun. 22, 1981

[30] Foreign Application Priority Data

Jun. 27, 1980 [JP] Japan ..... 55-86497
Aug. 15, 1980 [JP] Japan ..... 55-111776

[51] Int. Cl.[3] ..... D03D 47/36

[52] U.S. Cl. ..... 139/452; 66/132 R; 242/47.12

[58] Field of Search ..... 139/452, 435; 66/132 R; 242/47.01, 47.12

[56] References Cited

U.S. PATENT DOCUMENTS 2,519,786 8/1950 Paabo ..... 139/452 X
3,737,112 6/1973 Tellerman et al. ..... 242/47.12
4,132,370 1/1979 van Mullekom ..... 242/47.12

FOREIGN PATENT DOCUMENTS 162105 2/1976 Czechoslovakia .
24561 7/1980 European Pat. Off. .
2039716 4/1971 Fed. Rep. of Germany .
2111671 9/1972 Fed. Rep. of Germany .
1478294 4/1967 France .
467960 4/1975 U.S.S.R. .

*Primary Examiner*—James Kee Chi
*Attorney, Agent, or Firm*—Schwartz, Jeffery, Schwaab, Mack, Blumenthal & Koch

[57] ABSTRACT

A weft detaining device of a shuttleless loom, comprises a stationary drum located between a weft source and a weft inserting nozzle and formed with first and second holes which are spaced in the axial direction of the drum, a weft wind-guide member located near the peripheral surface of the drum and rotatable around the drum peripheral surface to guide a weft yarn to be wound around the drum peripheral surface, first and second levers located outside of the drum and formed respectively with first and second hook sections which are capable of projecting respectively into the first and second holes of the drum so that the weft yarn in a predetermined length required for each weft picking is detained on the drum peripheral surface between the first and second hook sections, and a device for operating to cause the first and second hook sections to project respectively into first and second holes of the drum at predetermined timings in timed relation to the operational cycle of the loom, thereby facilitating adjustment and maintenance of the hook levers and the operating device thereof.

16 Claims, 6 Drawing Figures

WEFT DETAINING DEVICE OF SHUTTLELESS LOOM

BACKGROUND OF THE INVENTION

This invention relates to an improvement in a weft detaining device for a shuttleless loom, of the type wherein a certain length of a weft yarn required for each weft picking is detained prior to a weft injection through a weft inserting nozzle.

Many kinds of weft detaining devices have already been proposed and put into practical use. Of these, there is a drum type one which has been proposed by the inventors one of who is the same as in the present application and is disclosed in European Patent Application No. 80104480.1 entitled "Shuttleless Loom Weft Detaining Device". This drum type weft detaining device is constructed and arranged as follows: A rotatable drum is provided between a weft yarn supply device and a weft inserting nozzle, which drum is formed with a frustoconical section whose diameter gradually decreases in the direction of the weft inserting nozzle, and a cylindrical section integral with the frustoconical section. Additionally, the rotatable drum is provided with a first weft catching member located in the vicinity of the border of the frustoconical and cylindrical sections to catch the weft yarn at least for a period of weft picking in timed relation to the operational cycle of a loom, and a second weft catching member located at the cylindrical section to catch the weft yarn for a period except for at least the weft picking period in time relation to the loom operational cycle.

With this arrangement, the weft yarn in a length required for each weft picking is wound around the cylindrical section between the first and second weft catching members. Accordingly, the weft yarn can be smoothly drawn out from the drum during weft picking, so that an appreciable resistance is not applied to the weft yarn being drawn out during the weft picking, thereby preventing the weft yarn from being cut. However, a further improvement has been expected to the abovementioned drum type weft detaining device, because the first and second weft catching members and a device for operating them must be disposed within the rotatable drum whose inside space is not so large. This unavoidably restricts the freedom in selecting the size and construction of the weft catching members and the operating device therefor, accompanying with problems in which it is troublesome to adjust the operational timings and to make maintenance of the weft catching members and their operating device.

BRIEF SUMMARY OF THE INVENTION

According to the present invention, a weft detaining device of a shuttleless loom, consists of a stationary drum positioned between a weft source and a weft inserting nozzle. The drum is formed on its peripheral surface with first and second holes, the first hole being located farther from the weft inserting nozzle than said second hole in the axial direction of the drum. A weft windguide member is located near the peripheral surface of the drum and rotatable around the drum peripheral surface in timed relation to the operational cycle of the loom to guide the weft yarn between the weft inserting nozzle and the weft source to be wound around the peripheral surface of the drum. Additionally, first and second hook levers are provided outside of the drum and formed respectively with first and second hook sections which are capable of projecting respectively into the first and second holes of the drum to catch the weft yarn on the peripheral surface of the drum so as to prevent the weft yarn from moving, the weft yarn in a predetermined length required for each weft picking being detained on the drum peripheral surface between the first and second hook sections. The first and second hook sections are arranged to project respectively in the first and second holes of the drum at predetermined timings in timed relation to the operational cycle of the loom. With this arrangement, since the drum itself does not rotate, it has become possible to locate outside of the drum the hook levers for catching the weft yarn and a device for operating them. This has facilitates adjustment of the operational timings and maintenance of the hook levers and the operating device therefor.

BRIEF DESCRIPTION OF THE DRAWINGS

The feature and advantages of the weft detaining device according to the present invention will be more clearly appreciated from the following description taken in conjunction with the accompanying drawings in which the same reference numerals designate the same parts and elements, and in which.

DETAILED DESCRIPTION OF THE EMBODIMENTS OF THE INVENTION

Figure 1:
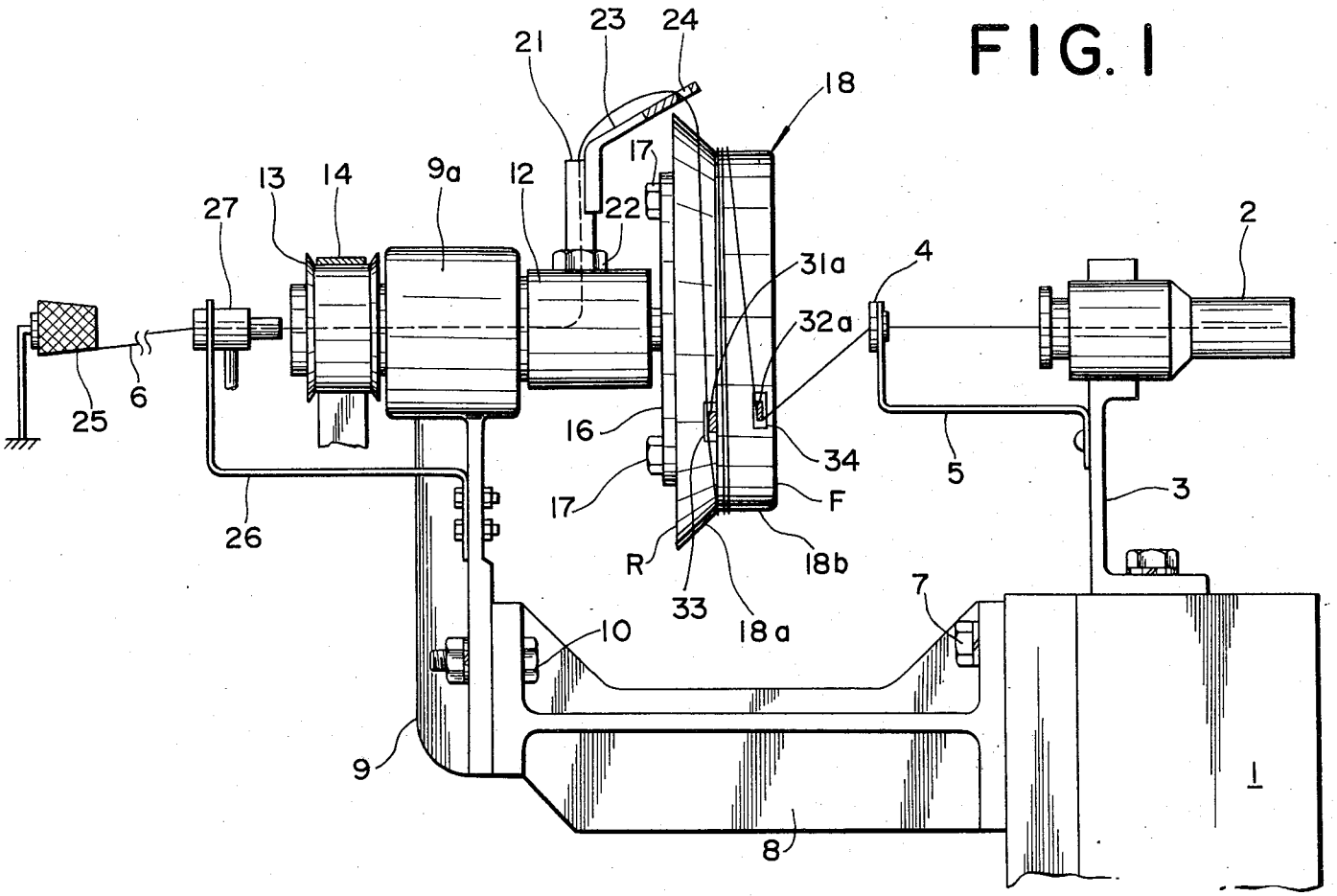
FIG. 1 is an elevational view of a preferred embodiment of a weft detaining device in accordance with the present invention.

Referring now to FIGS. 1 to 4 of the drawings, there is shown a preferred embodiment of a weft detaining device of a shuttleless loom, in accordance with the present invention. The shuttleless loom consists of a weft inserting air injection nozzle 2 which is supported by a nozzle holder 3 which is fixed on a frame 1 of the shuttleless loom. A weft guide 4 is supported by a stay 5 which is secured to the nozzle holder 3, and located rearward of the nozzle 2 so that the axis thereof is in alignment with that of the nozzle 2. Accordingly, a weft yarn 6 from the weft detaining device discussed hereinafter is introduced into the nozzle 2 through the weft guide 4, and then picked or inserted into a warp shed (not shown) by means of air injected from the nozzle.

A bracket 9 having a bearing section **9*a* is secured to the frame 1 of the shuttleless loom through a horizontally disposed bracket 8 which is directly secured to the frame of the loom by bolts 7, as shown in FIG. 1. The bracket 9 is connected at its bottom part to the bracket 8 with bolts 10 and nuts so that the axis of the bearing section 9*a* is in alignment with that of the weft guide 4**.

Figure 2:
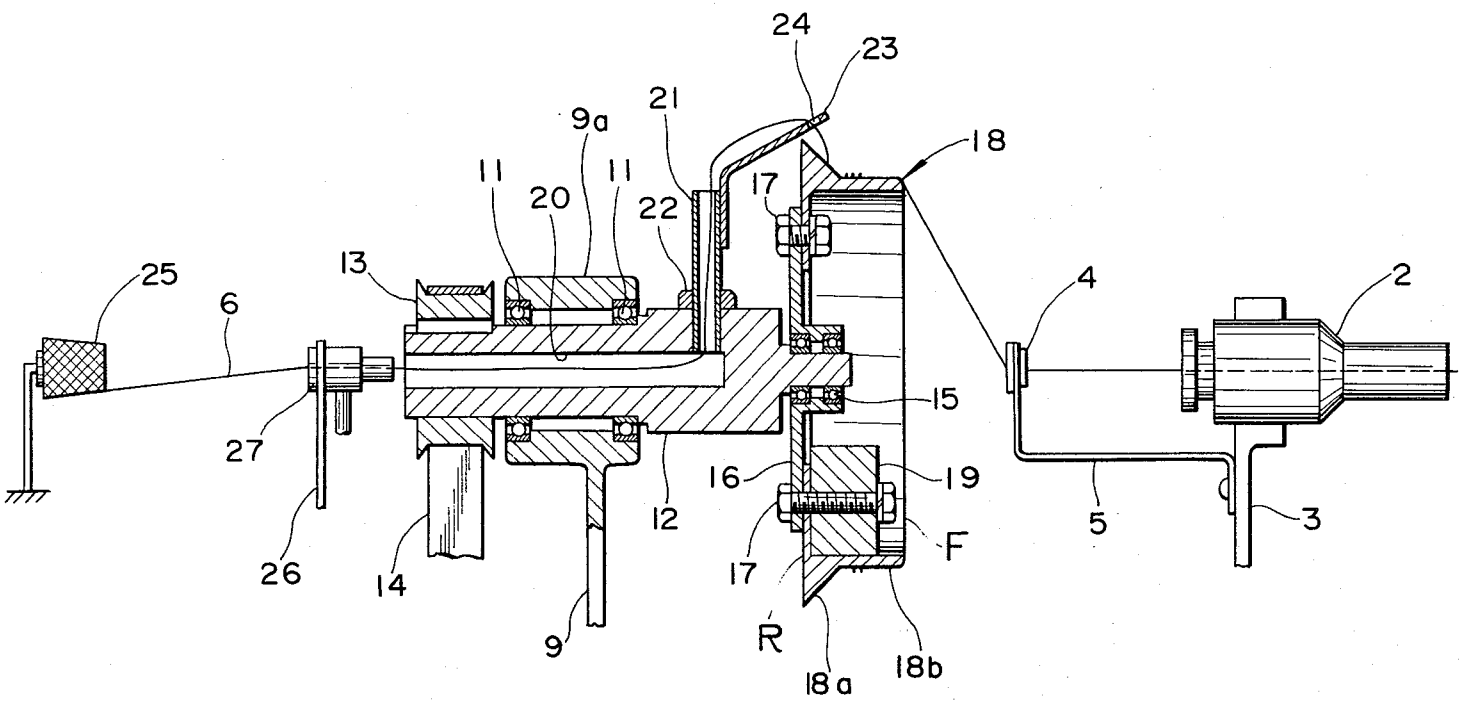
FIG. 2 is a vertical sectional view of the weft detaining device of FIG. 1.

As clearly shown in FIG. 2, a shaft 12 is rotatably supported at its central section within the bearing section **9*a* by a ball bearings 11. A toothed pulley 13 is fixedly mounted on a rear section of the rotatable shaft 12. A toothed belt 14** is provided to connect the pulley 13 and a drive pulley (not shown) to rotate the rotatable shaft 12 in accordance with the operation of the loom. The following illustration will be made in the case where the transmission ratio or a ratio between the rotation of the rotatable shaft 12 and the operational cycle of the loom is 3:1 in which the rotatable shaft 12 rotates three times per each operational cycle of the loom.

A support member 16 is rotatably mounted through ball bearings 15 on a front section of the rotatable shaft 12 so as to be rotatable relative to the shaft 12. A drum 18 forming part of the weft detaining device is fixedly supported by the support member 16 by means of bolts 17. A weight member 19 is located within a drum 18 and secured to the inside wall surface of the drum by means of the bolts 17. The drum 18 is so fixed to the support member 16 that the weight member lies at the lowermost position. The drum 18 is formed with an outer peripheral surface which comprises a frustoconical section 18*a* connecting to the rear end R of the drum and whose diameter gradually decreases in the direction of the weft inserting nozzle 2, i.e. from the rear end R toward the front end F of the drum 18. The drum outer peripheral surface further comprises a cylindrical section 18*b* which integrally connects with the frustoconical section 18*a* and extends to the front end F of the drum 18. The diameter of the cylindrical section 18*b* is so set that the length of the weft yarn 6 wound three times around the cylindrical section 18*b* corresponds to the weft yarn length required for each pick. The cylindrical section 18*b* may be slightly tapered toward the front end F of the drum 18, in which the weft yarn 6 wound on the drum 18 can be smoothly drawn out therefrom during weft picking when an angle of the tapered surface relative to the horizontal plane is 0.5 degrees.

The rotatable shaft 12 is formed along the axis thereof with an elongate weft introduction hole 20 which opens to the rear end face of the rotatable shaft 12. Additionally, a pipe member 21 is screwed into an opening (no numeral) formed at the outer surface of the shaft 12 so that the inside of the pipe member 21 communicates with the weft introduction hole 20. The pipe member 21 is fixed to the shaft 12 by means of a lock nut 22. Securely attached to the free end section of the pipe member 21 is a weft winding guide member 23 through which the weft yarn 6 is guided onto the frustoconical section 18*a* of the drum 18. The weft winding guide member 23 is bent to approach the surface of the frustoconical section 18*a* and formed at its free end section with a weft guide opening 24 through which the weft yarn passes. Accordingly, the weft yarn 6 drawn from a weft supply source or bobbin 25 is introduced into the weft introduction hole 20 and the pipe member 21 after passed through an air injection nozzle 27 for weft yarn introduction. The nozzle 27 is supported by a stay 26 fixed onto the bracket 9 and located rearward of the rotatable shaft 12 so that the axes of the nozzle 27 and the shaft 12 are aligned with each other. Subsequently, after introduced along the winding guide member 23 and passed through the opening 24, the weft yarn 6 is wound around the frustoconical section 18*a* and the cylindrical section 18*b*, in which the weft yarn 6 is catched by at least one of hook levers 31 and 32 which will be discussed hereinafter. Then, the weft yarn 6 is passed through the weft guide 4.

Figure 3:
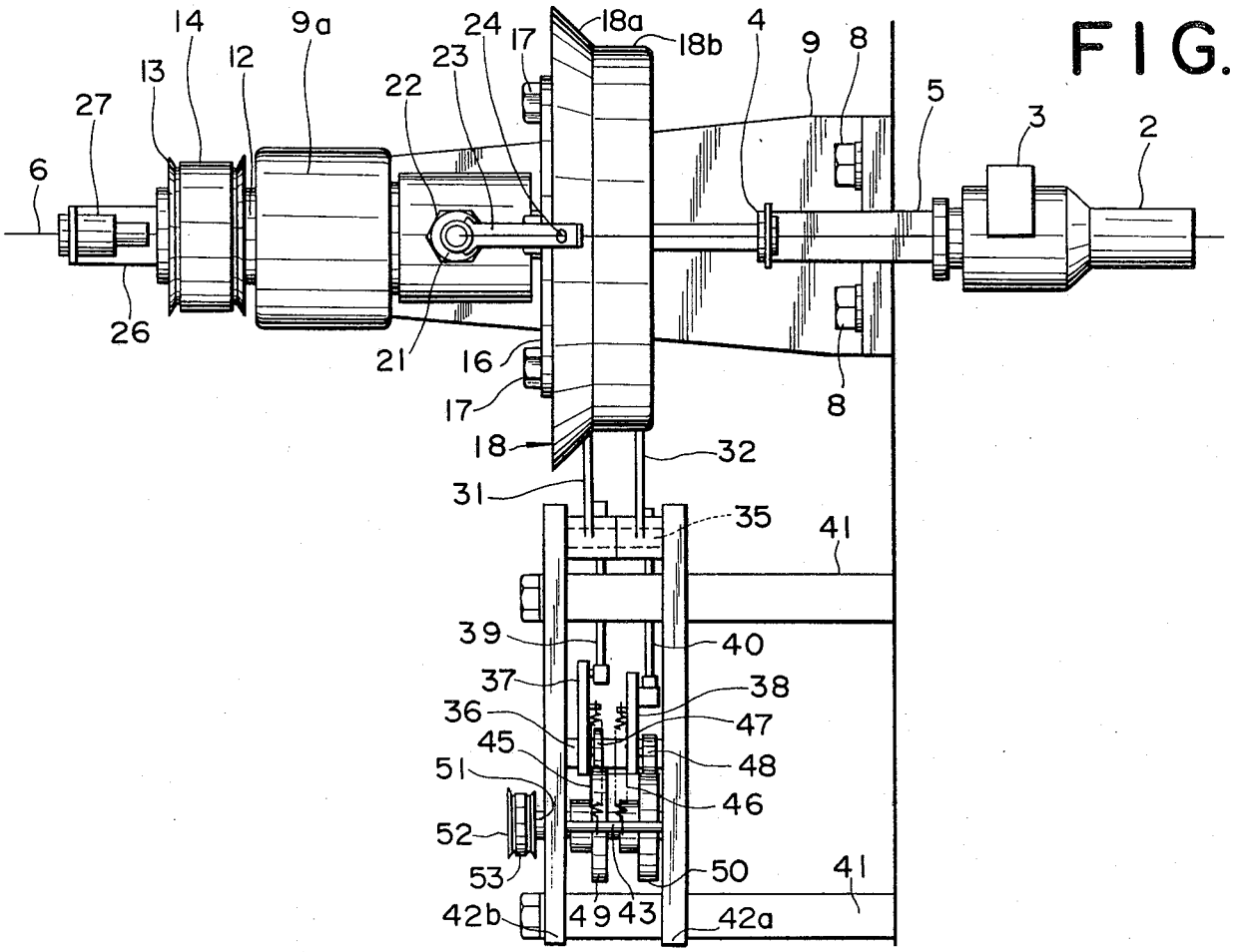
FIG. 3 is a plan view of the weft detaining device of FIG. 1.
Figure 4:
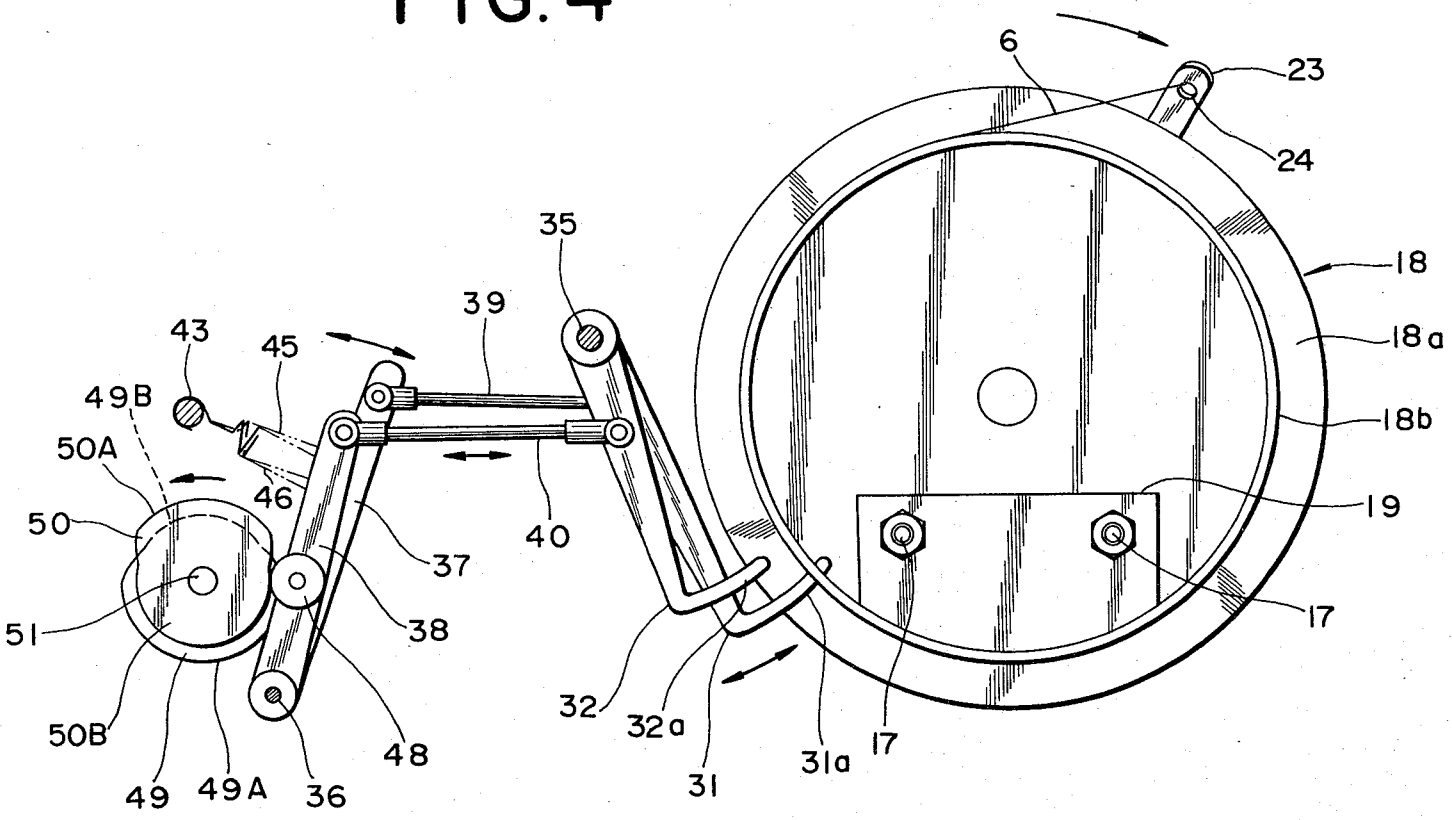
FIG. 4 is a side elevation of the weft detaining device of FIG. 1.

As shown in FIGS. 3 and 4, the hook levers 31 and 32 are pivotally and rotatably mounted on a fixed shaft 35 and formed at their end sections with hook sections 31*a* and 32*a*, respectively. The hook sections 31*a* and 32*a* are located to be able to be inserted respectively into holes 33 and 34 which are located on the frustoconical section 18*a* in the vicinity of the boader with the cylindrical section 18*b* and on the cylindrical section 18*b*, respectively. In this instance, the holes 33 and 34 pass through or pierce the wall of the drum 18. Additionally, swingable levers 37 and 38 are pivotally and rotatably mounted on a fixed shaft 36, and connect at their free ends with the central sections of the hook levers 31 and 32 through rods 39 and 40, respectively. The fixed shafts 35 and 36 are fixedly supported by a pair of support plates 42*a* and 42*b* which are secured by studs 41 fixed onto the outer surface of the loom frame 1. The swingable levers 37 and 38 are provided at their central sections with cam rollers or followers 47 and 48 and biased counterclockwise in FIG. 4 by springs 45 and 46, respectively. The springs 45 and 46 are disposed between a fixed pin 43 and the swingable levers 37 and 38, so that the cam rollers 47 and 48 are in contact with cams 49 and 50, respectively. The cams 49 and 50 are fixedly mounted on a rotatable shaft 51 which is rotatably supported by the pair of support plates 42*a* and 42*b*. A toothed pulley 52 is fixedly mounted on the rotatable shaft 51 and rotated through a toothed belt 53 by a drive pulley (not shown) so that the rotatable shaft 51 rotates one time per each operational cycle of the loom. The cams 49 and 50 are formed with high lobe sections 49A, 50A and low lobe sections 49B, 50B. With this arrangement, when the high lobe section 49A, 50A of the cam 49, 50 contacts the cam roller 47, 48, the swingable lever 37, 38 rotates clockwise in FIG. 4. As a result, the hook lever 37, 38 rotates counterclockwise in FIG. 4 so that the hook section 31*a*, 32*a* is inserted into the hole 33, 34 of the drum 18. When the low lobe section 49B, 50B of the cam 49, 50 contacts the cam roller 47, 48, the hook section 31*a*, 32*a* is withdrawn from the drum hole 33, 34.

The manner of operation of the weft detaining device will be discussed thereinafter.

During operation of the loom, the rotatable shaft 12 rotates three times per each operational cycle of the loom; however the drum 18 cannot rotate and is maintained at a stationary state by virtue of gravity due to the weight member 19. Accordingly, with the rotation of the rotatable shaft 12, the pipe member 21 and accordingly the weft winding guide member 23 rotates around the periphery of the drum 18, so that the weft yarn 6 is wound around the frustoconical section 18*a* of the drum 18. Then, the weft yarn on the frustoconical section 18*a* slides along the slope of frustoconical section 18*a* by the tension thereof and moves to the cylindrical section 18*b*, pushing the wound weft yarn located forward thereof.

When the operational cycle of the loom reaches a time immediately before a weft picking, the cam high lobe sections 49A and 50A respectively contact the cam rollers 47, 48 and accordingly the hook sections 31*a* and 32*a* of the hook levers 31 and 32 are respectively inserted into the holes 33 and 34 of the drum 18. In this state, the weft yarn 6 is caught by the hook section 31*a* of the hook lever 31 and thereafter caught by the hook section 32*a* of the hook lever 32 after wound three times around the cylindrical section 18*b*. When the operational cycle of the loom advances from this state, the high lobe section 49A of the cam 49 remains contacted with the cam roller 47, but the low lobe section 50B of the cam 50 is brought into contact with the cam roller 48, thereby causing the hook section 32*a* of the hook lever 32 to withdraw from the hole 34 of the drum 18. Accordingly, the restriction to the weft yarn 6 is cancelled, so that the weft yarn is picked by the air injection of the weft inserting nozzle 2 which air injection starts immediately before the withdrawn of the hook section 32*a*. When the amount of the wound weft yarn on the cylindrical section 18*b* becomes nothing or zero by this weft picking, the weft yarn 6 is caught by the hook section 31*a* of the hook lever 31, by which the weft picking is completed. Since the weft winding guide member 23 makes about one turn during this weft picking, the weft yarn 6 is wound about one time around the frustoconical section 18*a* at the rear side of the hook section 31*a*. Immediately thereafter, firstly the high lobe section 50A of the cam 50 is brought into contact with the cam roller 48 and consequently the hook section 32*a* of the hook lever 32 is again inserted into the hole 34 of the drum 18. Subsequently, the low lobe section 49B of the cam 49 is brought into contact with the cam roller 47 and consequently the hook section 31*a* of the hook lever 31 is withdrawn from the hole 33 of the drum 18. Then, the weft yarn wound around the frustoconical section 18*a* slides down and moves to the cylindrical section 18*b*, so that the weft yarn becomes to be caught by the hook section 32*a* of the hook lever 32.

When the weft yarn 6 is wound about three times around the cylindrical section 18*b*, the high lobe section 49A of the cam 49 contacts the cam roller 47 and therefore the hook section 31*a* of the hook lever 31 is projected into between the weft yarn section wound around the frustoconical section 18*a* and the weft yarn section wound around the cylindrical section 18*b* to separate them each other. Immediately thereafter, the weft picking is carried out as discussed above.

Figure 5:
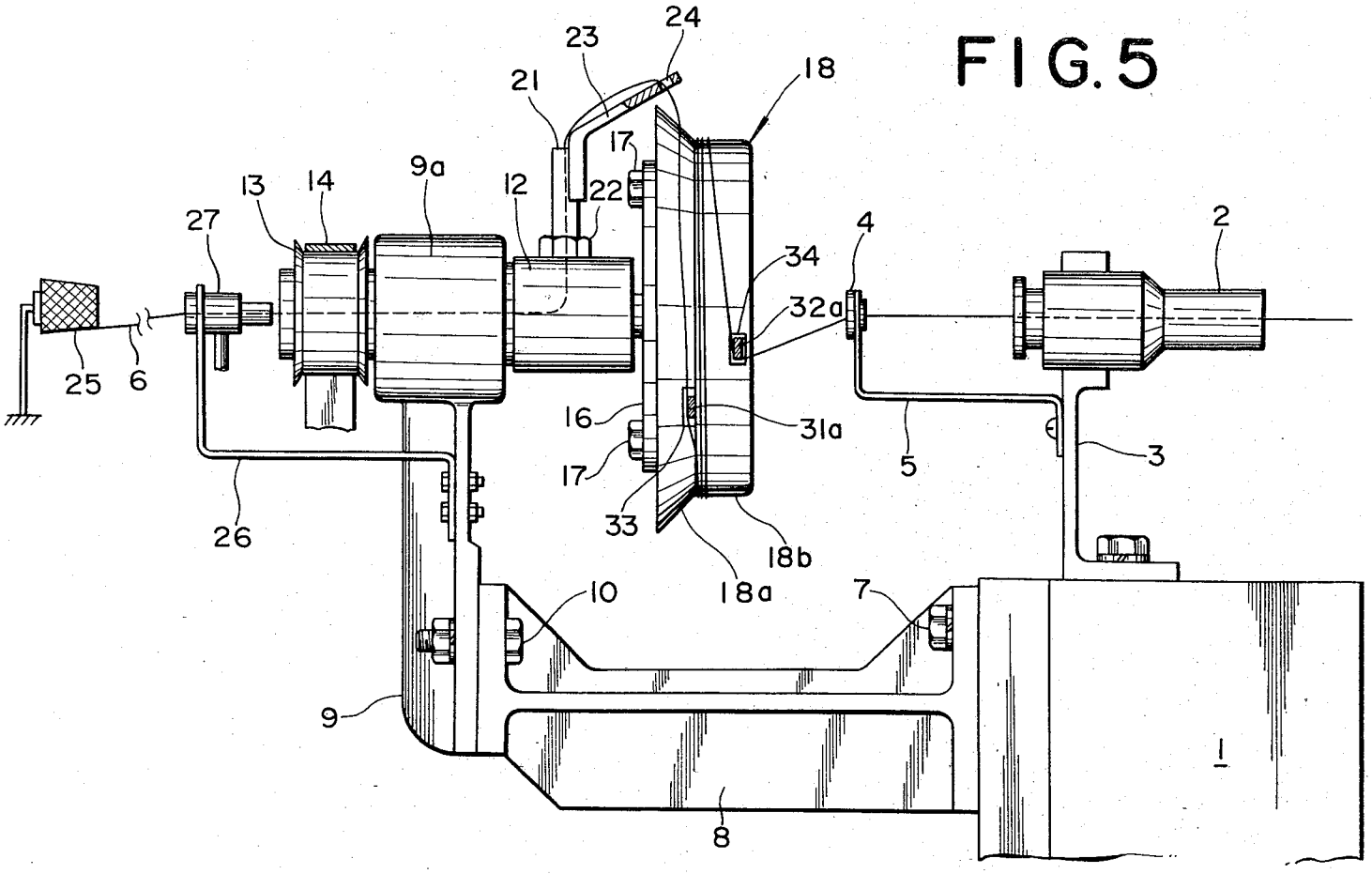
FIG. 5 is an elevational view of a modified example of the weft detaining device according to the present invention.
Figure 6:
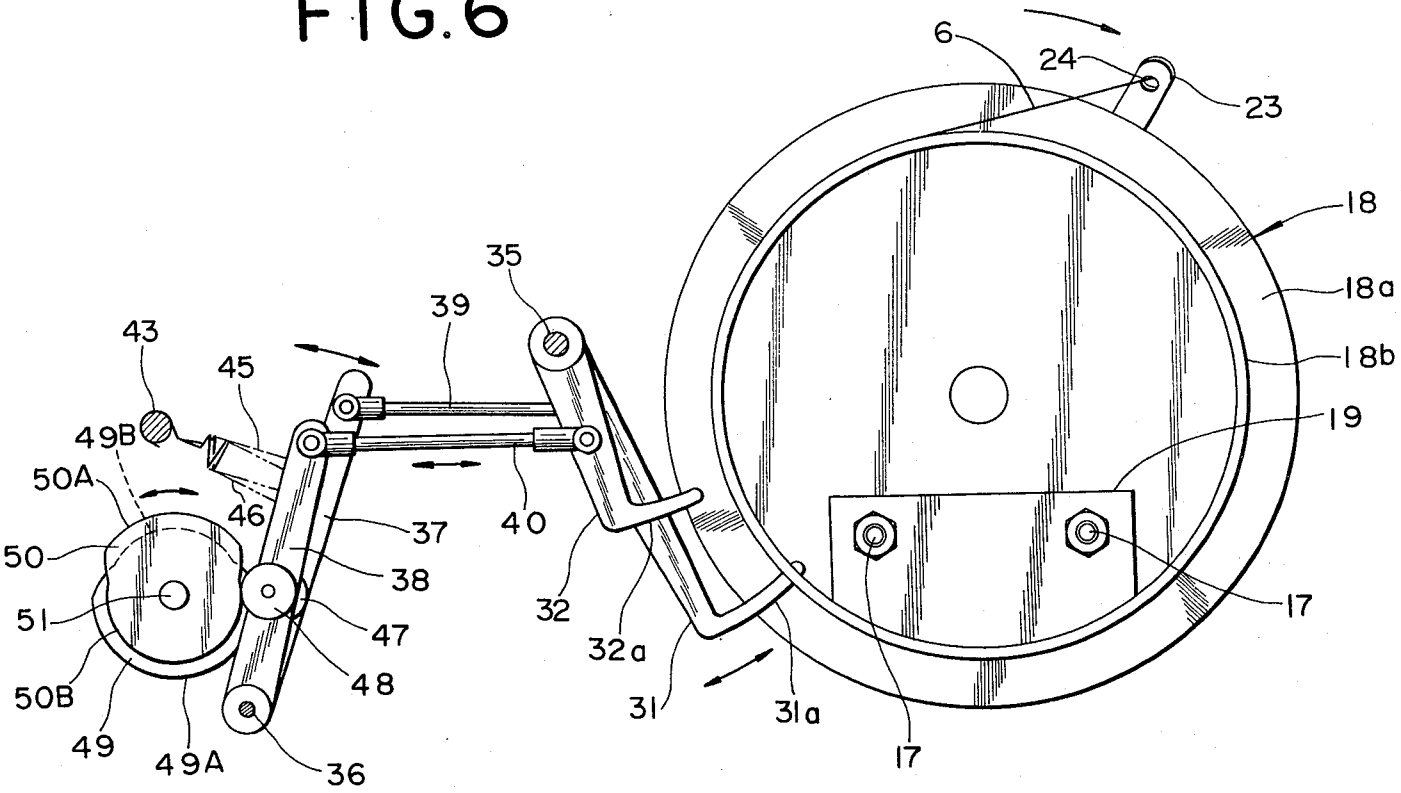
FIG. 6 is a side elevation of the weft detaining device of FIG. 5.

FIGS. 5 and 6 illustrates a modified example of the weft detaining device in accordance with the present invention, which is similar to the embodiment shown in FIGS. 1 to 4 except for the following points: The hole 34 is formed appreciably forward of the hole 33 in the direction where the weft yarn 6 is wound around the drum, i.e. in the direction of an arrow shown in FIG. 6. In this connection, the hook section 32*a* of the hook lever 32 is arranged to project to a position which is appreciably forward relative to the a position where the hook section 31*a* of the hook lever 31 projects. Additionally, the operational cycle of the loom in this instance is so set that, at the closing period of a beating-up operation of a reed (not shown), the contact point of the cam roller 48 moves from the low lobe section 50B to the high lobe section 50A of the cam 50, and the contact point of the cam 47 moves from the high lobe section 49A to the low lobe section 49B of the cam 49.

With this arrangement, the weft detaining device as shown in FIGS. 5 and 6 operates as follows: When the operational cycle of the loom reaches the time immediately before the weft picking, the cam high lobe sections 49A and 50A respectively contact the cam rollers 47, 48 and accordingly the hook sections 31*a* and 32*a* of the hool levers 31 and 32 respectively are inserted into the holes 33 and 34 of the drum 18. In this state, the weft yarn 6 is caught by the hook section 31*a* of the hook lever 31 and thereafter caught by the hook section 32*a* of the hook lever 32 after wound three turns around the cylindrical section 18*b*. When the operational cycle of the loom advances from this state, the high lobe section 49A of the cam 49 remains contacted with the cam roller 47, but the low lobe section 50B of the cam 50 is brought into contact with the cam roller 48, thereby causing the hook section 32*a* of the hook lever 32 to withdraw from the hole 34 of the drum 18. Accordingly, the restriction to the weft yarn 6 is cancelled, so that the weft yarn is picked by the air injection of the weft inserting nozzle 2 which air injection starts immediately before the withdrawn of the hook section 32*a*. When the amount of the wound weft yarn on the cylindrical section 18*b* becomes nothing or zero by this weft picking, the weft yarn 6 is caught by the hook section 31*a* of the hook lever 31, by which the weft picking is completed. Since the weft winding guide member 23 makes about one turn during this weft picking, the weft yarn 6 is wound about one time around the frustoconical section 18*a* at the rear side relative to the hook section 31*a*.

At the beating-up step, the weft yarn 6 is wound about two times around the frustoconical section 18*a*. Then, firstly the high lobe section 50A of the cam 50 is brought into contact with the cam roller 48 and consequently the hook section 32*a* of the hook lever 32 is again inserted into the hole 34 of the drum 18. Subsequently, the low lobe section 49*b* of the cam 49 is brought into contact with the cam roller 47 and consequently the hook section 31*a* of the hook lever 31 is withdrawn from the hole 33 of the drum 18. As a result, the weft yarn 6 which has been caught by the hook section 31*a* slides down along the slope of the frustoconical section 18*a* and moves onto the cylindrical section 18*b* to be caught by the hook section 32*a*.

At this stage, when the catching action to the weft yarn 6 is taken over from the hook section 31*a* to the hook section 32*a*, it is possible to draw out from the drum 18 the weft yarn 6 in a length corresponding to the distance between the hook sections 31*a* and 32*a* since the hook section 32*a* is located rearward relative to the hook section 31*a* in the direction where the weft yarn 6 is drawn off. Therefore, during the beating-up operation in which the picked weft yarn is beaten up against a cloth fel of a woven fabric (not shown), the weft yarn 6 on the drum 8 is suitably drawn off due to a weft yarn tension rise by an advancing movement of the reed. This relaxes the tension rise of the weft yarn 6 during the beating-up operation, thereby preventing the weft yarn from being cut. Then, when the weft yarn 6 is wound about three times around the cylindrical section 18*b*, the high lobe section 49A of the cam 49 contacts the cam roller 47 and therefore the hook section 31*a* of the hook lever 31 is projected into between the weft yarn sections respectively wound around the frustoconical and cylindrical sections 18*a* and 18*b* to separate them each other. Immediately thereafter, the weft picking is carried out as discussed above.

While the air injection nozzle 27 for weft introduction has been shown and described as used for decreasing the resistance to weft supply in the above-discussed embodiments, it will be understood that the air injection nozzle 27 is not necessarily required and accordingly may be omitted. In case where the air injection nozzle 27 is not used, the introduction of the weft yarn from the weft supply bobbin 25 to the weft detaining device is carried out by catching the weft yarn with the leading end of a wire passed through the weft introduction hole 20 and the pipe member 21.

In order to prevent the weft yarn drawn from the drum from being unnecessarily caught by the hook section 32*a* being withdrawn from the hole of the drum by so-called ballooning phenomena during weft picking, a guide for restricting the movement of the weft yarn may be provided around the drum 18.

While only the weight member 19 has been shown and described as means for maintaining the drum 18 at a stationary state in the above-discussed embodiments, it will be understood that the drum 18 may be maintained at the stationary state by disposing an iron piece or a magnet piece within the drum 18 and locating a magnet piece outside of the drum and at a position corresponding to the iron or magnet piece within the drum. Additionally, although the hole 33, 34 for receiving the hook sections 31*a* and 31*b* of the hook levers 31 and 32 have been shown and described as through-holes, it will be understood that the hole may be in the form of cavity or depression.

As appreciated from the foregoing, according to the present invention, since the drum forming part of the weft detaining device does not rotate itself, it has become possible to locate the hook levers and operating device therefor outside of the drum, thereby facilitating the timing adjustment and maintenance of the hook levers and the operating devices therefor. Furthermore, an improvement is made to the weft detaining device according to the present invention by spacing the hook sections 31*a*, 32*a* of two hook levers 31, 32 from each other in the direction of the periphery of the drum 18, in which a slight amount of the weft yarn can be drawn out of the drum during the beating-up operation to relax a tension rise of the weft yarn 6, thereby effectively preventing the weft yarn from being cut.

What is claimed is:

1. A weft detaining device of a shuttleless loom having a weft inserting nozzle for picking a weft yarn from a weft source, comprising:

a stationary drum formed on its peripheral surface with first and second holes, said first hole being located farther from the weft inserting nozzle than said second hole in the axial direction of said drum;

a weft wind-guide member located near the peripheral surface of said drum and rotatable around the drum peripheral surface in timed relation to the operational cycle of the loom to guide the weft yarn between the weft inserting nozzle and the weft source to be wound around the peripheral surface of said drum;

first and second hook levers located outside of said drum and formed respectively with first and second hook sections which are capable of projecting respectively into said first and second holes of said drum to catch the weft yarn on the drum peripheral surface so as to prevent the weft yarn from moving, a predetermined length of the weft yarn for each weft picking being detained between said projected first and second hook sections; and means for causing said first and second hook sections to project respectively into the first and second holes of the drum at predetermined timings in timed relation to the operational cycle of the loom.

2. A weft detaining device as claimed in claim 1, wherein the peripheral surface of said stationary drum includes a frustoconical section whose diameter decreases in the direction of the weft inserting nozzle, and a cylindrical section integral with said frustoconical section and located nearer to the weft inserting nozzle than said frustoconical section, in which said first hole is located in the vicinity of a border between said frustoconical and cylindrical sections, and said second hole is located on said cylindrical section.

3. A weft detaining device as claimed in claim 1, wherein said causing means causes said first hook section to project at least for a period of weft picking, and said second hook section to project for a period except for at least the weft picking period.

4. A weft detaining device as claimed in claim 1, further comprising a shaft rotatable in timed relation to the operational cycle of the loom, said weft wind-guide member being fixedly connected to said rotatable shaft so as to rotate with said rotatable shaft.

5. A weft detaining device as claimed in claim 4, wherein said drum mounted on said rotatable shaft and rotatable relative to said rotatable shaft, in which further comprising means for maintaining said drum at a stationary state regardless of the rotation of said rotatable shaft.

6. A weft detaining device as claimed in claim 5, wherein said maintaining means includes a weight member securely disposed inside of said drum.

7. A weft detaining device as claimed in claim 4, wherein said rotatable shaft is formed with an elongate hole which is along the axis of said rotatable shaft and opens to an end face, the weft yarn from the weft source being introduced into said elongate hole to be guided to said weft wind-guide member.

8. A weft detaining device as claimed in claim 7, further comprising a pipe member fixedly disposed on the outer surface of said rotatable shaft so that the inside of said pipe member communicates with said elongate hole so as to allow the weft yarn to pass through the inside of said pipe member.

9. A weft detaining device as claimed in claim 8, wherein said weft wind-guide member is secured to said pipe member and formed at its tip section with a weft guide opening through which the weft yarn through the inside of said pipe member is guided onto said frustoconical section of said drum peripheral surface.

10. A weft detaining device as claimed in claim 3, wherein said second hole is located forward of said first hole in the direction where the weft yarn is wound around the peripheral surface of said drum.

11. A weft detaining device as claimed in claim 3, wherein said first and second hook levers are pivotally mounted on a fixed shaft so that said first and second hook sections move toward and away from the peripheral surface of said drum in timed relation to the operational cycle of the loom.

12. A weft detaining device as claimed in claim 11, wherein said causing means includes first and second swingable levers pivotally mounted on a fixed shaft and respectively connected at their free end with said first and second hook levers, said first and second swingable levers being provided with first and second cam rollers, respectively, and first and second cams in contact respectively with said first and second cam rollers and rotatable in timed relation to the operational cycle of the loom, each cam being formed with high and low lobe sections, the hook section of each hook lever being arranged to project into the corresponding hole upon contact of the corresponding cam roller with said high lobe section of the corresponding cam, whereas the hook section of each hook lever being arranged to withdrawn from the corresponding hole upon contact of the corresponding cam roller with said low lobe section of the corresponding cam.

13. A weft detaining device as claimed in claim 12, wherein said first and second cams are rotatable one time per an operational cycle of the loom.

14. A weft detaining device as claimed in claim 4, wherein said rotatable shaft is rotatable three times per an operational cycle of the loom.

15. A weft detaining device as claimed in claim 1, wherein said first and second holes are formed to pierce the wall of said drum.

16. A weft detaining device as claimed in claim 4, wherein the axes of said rotatable shaft and drum are aligned with the axis of the weft inserting nozzle.

* * * * *

UNITED STATES PATENT AND TRADEMARK OFFICE

CERTIFICATE OF CORRECTION

PATENT NO. : 4,378,821

DATED : April 5, 1983

INVENTOR(S) : Hidetusugu UMEZAWA

It is certified that error appears in the above—identified patent and that said Letters Patent is hereby corrected as shown below:

IN THE BIBLIOGRAPHICAL DATA

At line [75], change "Hidetsugu" to --Hidetsugu--; change "Narahashi" to --Higashiyamato--;

Signed and Sealed this

*Twelfth* Day of *June 1984*

[SEAL]

*Attest:*

GERALD J. MOSSINGHOFF

*Attesting Officer*

*Commissioner of Patents and Trademarks*